US011937654B2

(12) United States Patent
Henson et al.

(10) Patent No.: US 11,937,654 B2
(45) Date of Patent: Mar. 26, 2024

(54) DEVICE FOR ATTACHING A GARMENT HAVING A WAIST BAND TO SUSPENDERS

(71) Applicants: Randall S. Henson, Belle Center, OH (US); Randall S. Henson, II, Huntsville, OH (US)

(72) Inventors: Randall S. Henson, Belle Center, OH (US); Randall S. Henson, II, Huntsville, OH (US)

( * ) Notice: Subject to any disclaimer, the term of this patent is extended or adjusted under 35 U.S.C. 154(b) by 0 days.

(21) Appl. No.: 18/134,909

(22) Filed: Apr. 14, 2023

(65) Prior Publication Data

US 2023/0337773 A1 Oct. 26, 2023

Related U.S. Application Data

(60) Provisional application No. 63/412,057, filed on Sep. 30, 2022, provisional application No. 63/333,915, filed on Apr. 22, 2022.

(51) Int. Cl.

| | |
|---|---|
| ***A41F 3/02*** | (2006.01) |
| ***A41F 9/00*** | (2006.01) |
| ***A41F 18/00*** | (2006.01) |

(52) U.S. Cl.

CPC ..... *A41F 3/02* (2013.01); *A41F 9/00* (2013.01); *A41F 18/00* (2013.01)

(58) Field of Classification Search

CPC .. A41F 9/007; A41F 1/004; A41F 3/02; A41F 5/00; A41F 7/00; A41F 9/00; A41F 18/00; A41F 19/00; A41D 1/02; A41D 1/06; A41D 13/1161; A41D 13/0005; A41D 19/0051; A41D 19/0089; A41D 19/0006

See application file for complete search history.

(56) References Cited

U.S. PATENT DOCUMENTS

| | | | | |
|---|---|---|---|---|
| 1,478,521 | A * | 12/1923 | Kershner | A41F 9/00 2/236 |
| 1,610,079 | A * | 12/1926 | Duffy | A41D 13/02 2/230 |
| 1,877,697 | A * | 9/1932 | Schlusselberg | A41F 9/007 2/93 |
| 2,520,261 | A * | 8/1950 | Silman | A44B 17/007 24/95 |
| 5,560,045 | A | 10/1996 | Rockefeller | |
| 5,797,145 | A * | 8/1998 | Levinson | A41F 9/007 2/244 |
| 6,006,365 | A | 12/1999 | Strandberg | |
| 11,166,505 | B2 | 11/2021 | Gonzalez | |
| 2003/0159198 | A1* | 8/2003 | Rubin | A41F 9/007 2/244 |
| 2010/0313336 | A1* | 12/2010 | Carlson | F41C 33/041 2/338 |

(Continued)

*Primary Examiner* — Katherine M Moran

(74) *Attorney, Agent, or Firm* — Standley Law Group LLP; Kenny W. Pung; Jeffrey C. Norris

(57) ABSTRACT

A device, attachable to a waist band of a garment, facilitates the use of suspenders. An elongate rectangular body of the device has a front surface and a back surface. This body has ratio of length to width that is the range of about 4:1 to about 10:1, and a ratio of width to thickness in the range of about 8:1 to about 20:1. At least one knob having a head held in spaced-apart relationship with the body by a post is used to secure the suspenders. The elongate rectangular body and each knob are formed from a thermoplastic, preferably in an integral manner.

13 Claims, 11 Drawing Sheets

(56) References Cited

U.S. PATENT DOCUMENTS

2019/0365002 A1* 12/2019 Stevens ..... A41F 9/007
2021/0361001 A1* 11/2021 Gandara-Thomas .....
A62B 18/084

* cited by examiner

DEVICE FOR ATTACHING A GARMENT HAVING A WAIST BAND TO SUSPENDERS

CROSS-REFERENCE TO RELATED APPLICATIONS

This application is a nonprovisional of U.S. provisional patent application 63/333,915, filed on 22 Apr. 2022, and of U.S. provisional patent application 63/412,057, filed on 30 Sep. 2022, both of which are incorporated by reference as if fully recited herein.

TECHNICAL FIELD

The embodiments of the inventive concept disclosed herein relate to a garment accessory, specifically a garment fastener for removably attaching an article of clothing, such as a pair of trousers or a skirt, to suspenders. The device is attached to a waist band of the article of clothing and distributes the forces imposed onto the waist band by the suspenders. This significantly reduces the stresses that act on the waist band, reducing the potential for damaging the article of clothing, reducing the unsightly distortions of the waist band and improving the comfort of the wearer.

BACKGROUND OF THE ART

Suspenders, also known as braces or galluses, are a clothing accessory that tends to move in and out of fashion. In some instances, the use of suspenders is associated with very formal clothing, as in the case of tuxedos, and in other instances, suspenders are associated with work clothing. For example, suspenders are associated with woodsmen, loggers, and farmers. While not readily visible in use, suspenders are used by hockey players.

Suspenders may be more generally associated with men, but they are used by women to provide support for slacks or skirts.

The market for functional and creative clothing accessories is an international market that has continued to grow over the years. Suspenders provide a practical and artistic way to enhance an individual's personal appearance while performing the desired supporting function for the garment.

Beyond that, suspenders are readily recognized as being part of a phrase associated with minimizing danger by providing multiple layers of safety: "belt and suspenders." However, actually wearing both a belt and suspenders is a fashion faux pas, as the belt and suspenders probably act against each other in practice, distorting the waist band unnecessarily.

Particularly when the ends of the suspender straps are to be attached to buttons positioned around the waist band of a garment, the buttons, and especially the threads securing the buttons, are subjected to strong vertical forces. In the cases where a pair of spaced apart buttons are used to attach a single suspender strap, this vertical force is resolved into a lesser vertical force, but the resulting horizontal force also distorts the waist band and acts on the threads holding the buttons. The result is an unsightly distortion of the garment and potential damage to the garment.

Accordingly, it is an unmet need of the prior art to provide a device that absorbs the forces imposed on the waist band of a garment by suspenders rather than passing these forces onto the waist band.

SUMMARY

This and other objects of the invention are achieved by a device as described in more detail below.

In an exemplary embodiment, the device for attaching a garment having a waist band to suspenders includes an elongate rectangular body with a front surface and a back surface; a means for attaching a strap of the suspenders to the device, the means for attaching projecting from the front surface of the elongate rectangular body; and a means for attaching the elongate rectangular body to the garment.

In one or more embodiments, the elongate rectangular body has a ratio of length to width that is in the range of about 4:1 to about 10:1.

In one or more embodiments, the elongate rectangular body has a ratio of width to thickness in the range of about 8:1 to about 20:1.

In one or more embodiments, the means for attaching a strap of the suspenders to the device includes at least one knob projecting from a surface of the body, with each knob having a head held in spaced-apart relationship with the body by a post.

In one or more embodiments, the body and each knob may be formed from a thermoplastic.

In one or more embodiments, each knob may be integrally formed with the body.

In one or more embodiments, the means for attaching the elongate rectangular body to the garment includes at least one piece of a cover material encompassing the elongate rectangular body, with the at least one piece of cover material comprising a material suitable for being sewn to the garment.

BRIEF DESCRIPTION OF THE DRAWINGS

A better understanding will be obtained of the inventive concept when reference is made to the accompanying drawings, in which identical parts are identified by identical reference numbers and wherein.

DETAILED DESCRIPTION OF THE DRAWINGS

As generally known in the prior art, suspenders have two straps that extend down the front (ventral) torso of the wearer and either one or two straps that extend down the back (dorsal) torso of the wearer. Each strap is provided with a means for attaching the strap to the garment. In some cases, the means for attachment is a clip that grips a top edge of the waist band, or in a more limited number of cases, a top edge of a belt being worn in belt loops around the waist of the wearer. In a variation of this, the clip grips a button that is affixed to the waist band, on either the inside or outside surface of the garment.

More commonly, and particularly with suspenders that are worn with a more formal garment, such as a tuxedo or suit, the end of each suspender strap is provided with either a button loop for attachment to a single button, or a pair of button loops that are provided for attachment to a pair of spaced-apart buttons that are attached to the waist of the garment, on either the inside or outside surface.

Based on these variations, there are from three to eight points for attaching the suspenders around the waist band of the garment. In many of the embodiments, some current methods of attaching braces/suspenders to apparel are through the use of 6 buttons sewn into the waistband of the garment, metal clips that grip the material at the top of the waistband of the apparel, metal rivets put through the clothing with a screw on button like piece or an apparatus that is a combination of a clip and a button like piece.

These methods present numerous problems and shortcomings. Using individual buttons requires the buttons to be attached to the apparel in a correct spacing, both relative to each other and to the garment itself in order to provide optimal functionality and appearance. Although some clothing may be bought with individual buttons already in place, the buttons may not be properly positioned to fit the individual who will wear the garment.

Figure 1:
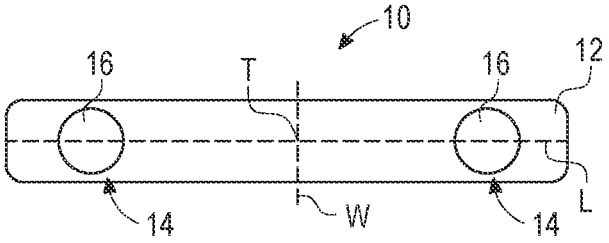
FIG. 1 is a front elevation view of an elongate rectangular body in isolation.

Into this arena, the inventors seek to propose an improved manner of attaching suspenders. FIG. 1 shows an isolated front elevation view of an element 10 around which the inventive concept is grounded. The element 10 has an elongate, generally rectangular body 12 with a pair of spaced-part knobs 14. In a particular embodiment, the body 12 has a length to width aspect of about 7:1, although this aspect may range from about 4:1 to about 10:1. The body 12 also has a thickness, such that a thickness to width aspect is in the range of 0.10:1 to about 0.30:1. The pair of spaced-apart knobs 14 are symmetrically spaced along a longitudinal axis L and are preferably equidistant from a transverse or width axis W. A third axis T extends normal to a plane defined by the L and W axes, traversing the thickness of body 12, and is seen in FIG. 1 only as a point. In the depicted embodiment, the knobs 14 are placed such that about 60% of the total length of the body 12 is between the knobs. The minimum spacing between the knobs 14, measured center-to-center, would be expected to be about 30% of the total length of the body 12. In an embodiment used with trousers, such as for a tuxedo, the center-to-center spacing would typically be 3 inches, but a range of from 2 to 4 inches would be expected, perhaps to suit an individual. In an embodiment intended for use with hockey pants, a center-to-center spacing of the knobs 14 would most likely be in the 1 inch to 3 inch range. Although not clearly visible in FIG. 1, each of the knobs 14 comprises a head 16 with a post (not visible) that affixes the knob to the body 12 The post keeps the head 16 in a fixed spacing away from the body 12. As seen in FIG. 1, the heads 16 have a diameter that is slightly smaller than the width of the body 12 for this embodiment, which would be typical for intended use with trousers. In a hockey embodiment, the body 12 would be expected to be wider, so the heads 16 would have a smaller diameter relative to the body. The post is preferably cylindrical and would preferably have a length, normal to the body 12, in the range of from about 200% to about 500% of the thickness of the body 12. The post would be preferred to have a diameter that is in the range of about 20% to about 40% of the diameter of the knob 14.

In order to have flexible strength in the overall device of the inventive concept, that flexible strength is necessarily encompassed in the element 10. For that reason, the clear preference is to manufacture the element 10 as an integral piece, especially with regard to the knobs 14 being integral to the body 12. This indicates a clear preference to use a thermoplastic material for the element 10, although a metal may be used. If a thermoplastic material is used, the manufacturing method could involve injection molding or could be achieved with a layer-by-layer manufacturing technique, such as the so-called "3D printing." Without intending to limit the selection of material, some typical thermoplastics would include polyethylene, polypropylene, poly(ethylene terephthalate), polystyrene, polyamide, or a co-polymer, such as an acrylonitrile-butadiene-styrene ("ABS"). In exemplary embodiments, the device may be fabricated from material having sufficient heat resistance so as to withstand various cleaning processes such as being washed in a washing machine, being dried in a dryer, and being dry cleaned. Such a material may include, for example, high density polyethylene (HDPE).

As noted above, the body 12 has three axes, namely L, W, and T. Because of the relative dimensions, the body 12 is constrained in how it will react to a force acting on it. A force acting normal to the L-W plane, that is, one acting along the T axis would be expected to cause the body 12 to deform into or out of the L-W plane. The T axis is seen on FIG. 1 as a dot at the intersection of the L and W axes. A force acting normal to the W-T plane or a force acting normal to the L-T plane would not be expected to cause the body to deform.

Figure 2:
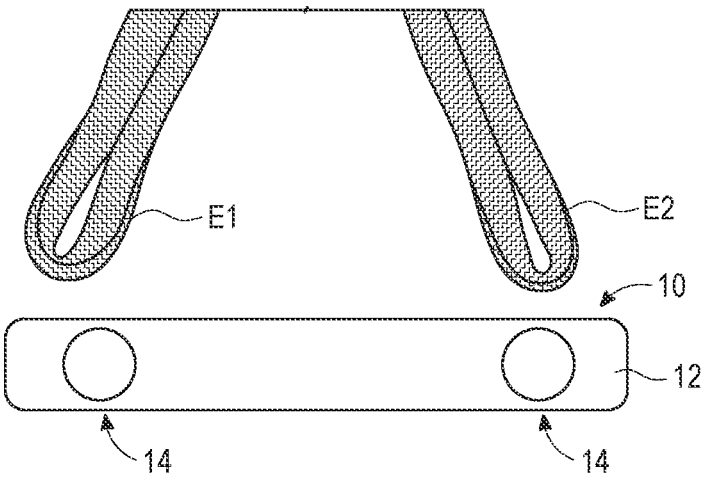
FIG. 2 is a front elevation view of the FIG. 1 body with suspender button ends.

FIG. 2 shows a front elevation view of the body, as in FIG. 1, but with the addition of a pair of suspender button ends E1 and E2 As will be seen below. The bight or buttonhole B in each button end E1, E2, is sized so that it may be selectively engaged or disengaged by the respective knobs 14. It will be seen from this that if the element 10 is engaged with the waist band of a garment being suspended from the suspenders, the knobs 14 will be replacing the buttons, the body 12 will be replacing the waist band and the posts will be replacing the threads that hold the buttons in place. The body 12 has sufficient flexibility to deform around the waist of a wearer, but will resist both vertical and horizontal deformation, unlike the waist band, where both horizontal and vertical deformation is observed.

Figure 3:
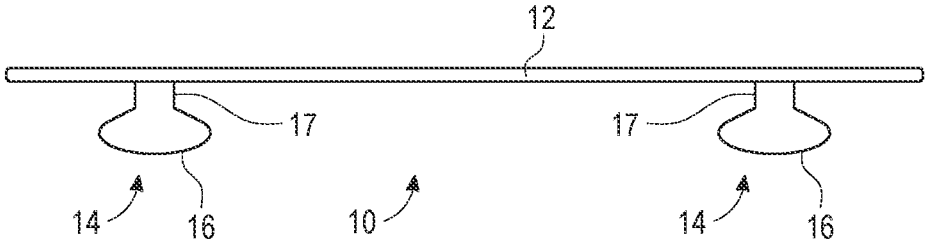
FIG. 3 is a sectional top plan view, taken along axis L in FIG. 1, showing further features of the elongate rectangular body in isolation.

A few additional features of the elongate rectangular body are seen FIG. 3, which presents a top plan sectional view of the element 10. Clearly visible in this view are the features of the knobs 14 and their relationship to the body 12. As described above, each knob 14 is affixed to, or preferably integral with, a front face of the body 12. The preferred manner of doing this is through a post 17 that spaces the head 16 away from the body.

Figure 4:
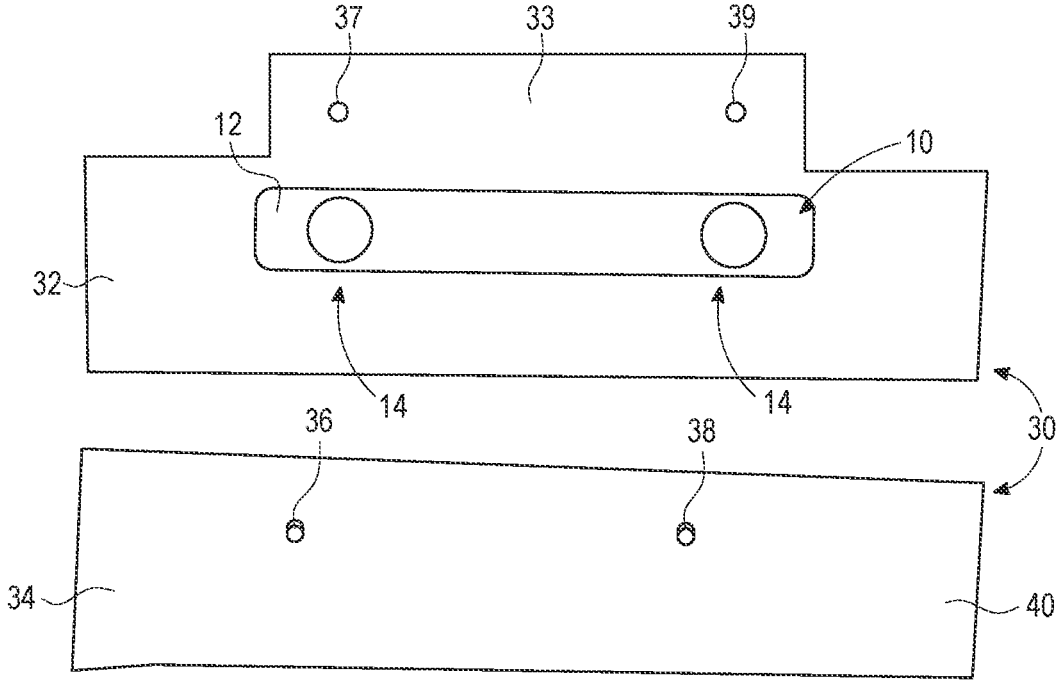
FIG. 4 is a perspective view of the FIG. 1 body with a first embodiment of a means for attaching to a waist band.

Turning attention, then, to FIG. 4, an additional part of the inventive concept is seen. In order to attach the element 10 to a waist band, it is necessary to provide a cover that encompasses the element 10 while allowing access to the knobs 14 and while providing surface area for attachment of the assembled device to a waist band, typically by sewing. To that end, FIG. 4 shows a cover 30 in association with element 10. In this embodiment, the cover comprises at least a first and a second cover piece 32, 34, and, as depicted, probably a third cover piece 33. The first cover piece 32, on which the element 10 is placed, is a rectangular piece of a material that is suitable for attachment to a waist band of a garment by sewing. The second cover piece 34 is preferably sized and shaped identically to the first cover piece 32, but has first and second slits 36, 38 that are spaced-apart to allow knobs 14 to protrude therethrough. By positioning second cover piece 34 atop first cover piece 32, while element 10 is sandwiched between them, the first and second cover pieces can be sewn, or otherwise secured to each other. Because each cover piece 32, 34 has a larger profile than element 10, the perimeter edges 40 provide an ample area to sew the cover pieces 32, 34 to each other and to sew the cover 30 to a waist band. In some aspects of the invention, it may be desirable to use a further means, such as an adhesive, for securing the cover pieces 32, 34 to each other and/or to the element 10.

As seen in FIG. 4, the third cover piece 33 is used to anchor the element 10 against upward motion. To do this, a separate piece of material, designated by reference number 33 is attached, preferably by sewing to the first cover piece 32 and folded over the element. Slits 37 and 39 are placed over knobs 14 before slits 36, 38 are placed over knobs 14. In an alternative, a portion of the first cover piece 32 can be formed into a rectangular flap joined to the first cover piece along a lower edge of the flap. The flap is then provided with slits 37 and 39 and the slits are secured onto the knobs 14, providing a close equivalent to the use of the third cover piece 33.

Figure 5:
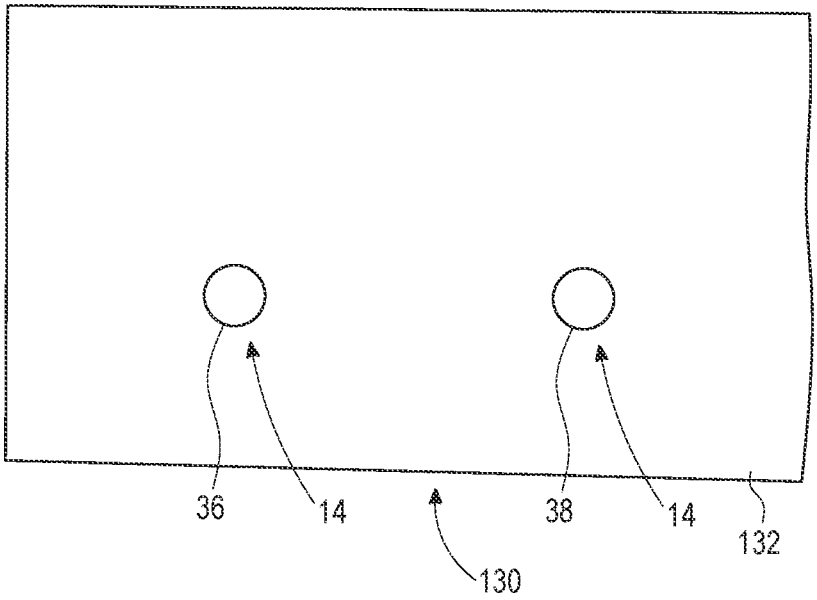
FIG. 5 is a perspective view of the FIG. 1 body with a second embodiment of a means for attaching to a waist band.

FIG. 5 shows an elevation view of another embodiment of the inventive concept, in which the element 10 is in the process of being encompassed in an alternate cover 130. In this case, a single piece 132 of material suitable for sewing is used rather than two separate pieces, as seen in cover 30. However, cover 130 has first and second slits 36, 38 that are spaced-apart to allow knobs 14 to protrude therethrough, which is clearly seen. In fact, knobs 14 are the only part of element 10 seen in FIG. 4. By folding an upper portion of the single piece 132 over element 10 to be in registration with itself, the resulting cover 130 has one folded edge and three edges that may be sewn together, in contrast to cover 30, which had four edges that needed to be sewed or otherwise joined. Because the single piece 132 has a larger profile than element 10, even when folded, the perimeter edges provide an ample area to sew the cover 130 to a waist band. In some aspects of the invention, it may be desirable to use a further means, such as an adhesive, for securing the surface of the single piece 132 that faces the element 10 to the element, as well as to itself.

On the issue of materials that can be used for the cover 30, 130, the clear requirement is that the cover needs to be able to be attached to the waist band, or at least the top, of the garment, that will be held in place by suspenders. A sturdy material is highly preferred. It can be a woven material, such as cloth, including, without limitation, denim. It can be a natural material, especially a soft leather. In many aspects, the precise decision on the material will be at least influenced by the specific garment to which the inventive device will be attached. For example, one would probably make a different decision regarding material for the cover 30, 130 that would be used with a pair of tuxedo trousers than for a cover that would be used with a pair of work pants.

Figure 6:
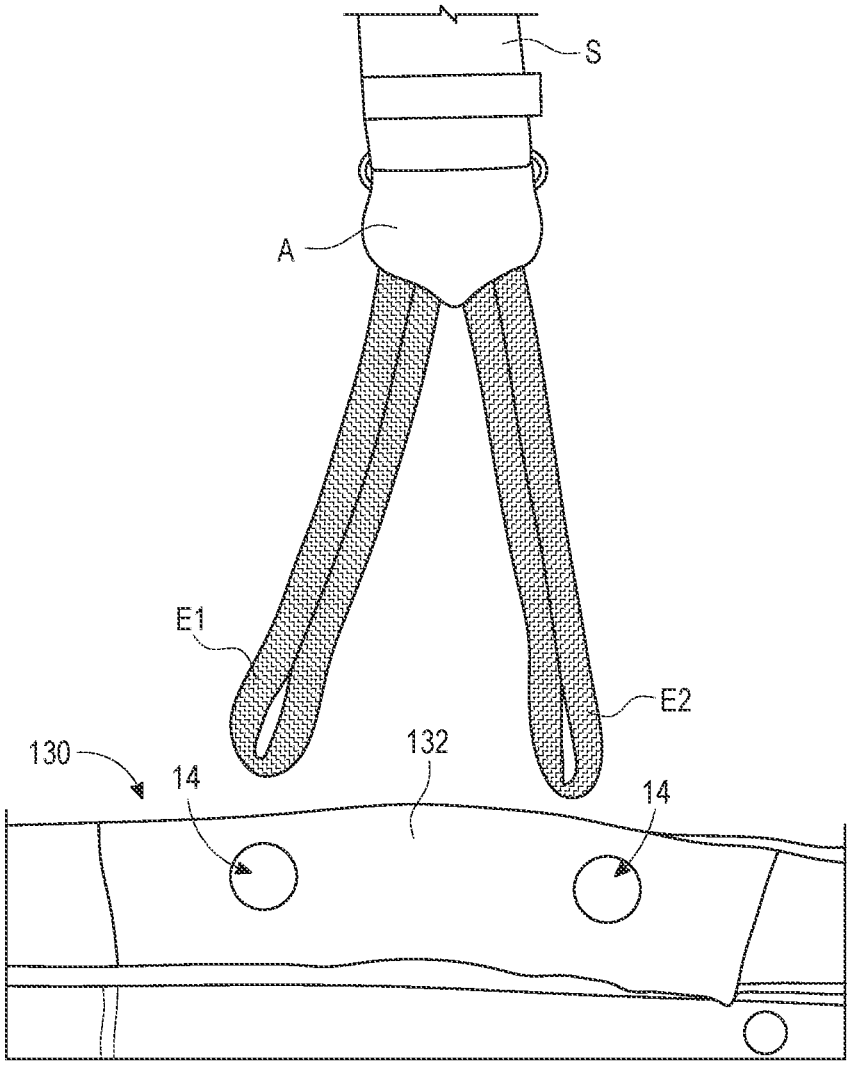
FIG. 6 is perspective view of the device of the inventive concept in association with a pair of trousers and suspender button ends.

Finally, FIG. 6 shows a perspective view of the device of the inventive concept in association with a pair of trousers and suspender button ends, in the manner that the invention would be employed. The cover 130 depicted is based on the embodiment seen in FIG. 4, but with the single piece 132 of material folded over to encompass the element 10. In FIG. 6, the fact that the open edges of the piece 132 of material are not yet sewn together is not considered consequential, as the same sewing step that is used to do this can also be used to secure the overall device to the waist of the garment, which in this case is a pair of jeans. The figure shows the inventive device position on the inside of the waist of the garment, that is, with the knobs 14 facing the wearer, but, depending on the circumstances, the inventive device may be positioned on the outside of the waist of the garment with no known adverse effect. The biggest influence on the location may be the existence (or absence of) a series of belt loops on the outside of the waist for accommodating a belt, as the inventive device could interfere with such belt loops.

Also visible in FIG. 6 is the attachment A of the suspender button ends E1, E2, to the suspender strap S. While these structures are well-known from the prior art and not directly affected by the inventive device, it is clear that a strictly vertical force acting along an axis of the suspender strap S is resolved by the suspender button ends E1, E2 into both a vertical component and a horizontal component that would act, if unconstrained, to push the knobs 14 together, bunching up the waist of the garment. The inventive device, when present, not only distributes the vertical force along the entire length of the inventive device, but also strongly opposes the horizontal component. The result is a more comfortable fit for the user and a more stylish look.

Figure 7:
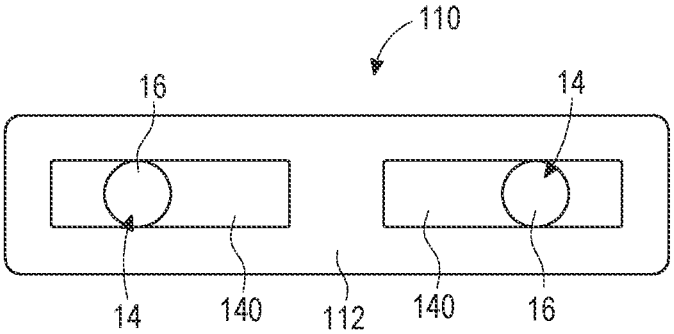
FIG. 7 is a front elevation view of a further embodiment of the inventive concept.
Figure 8:
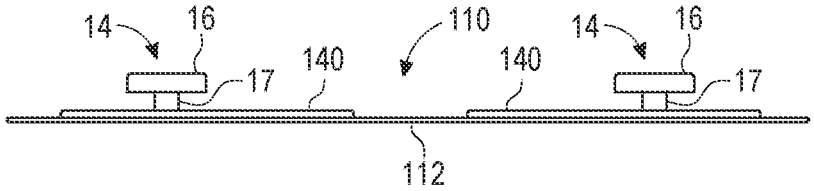
FIG. 8 is a top plan view of the FIG. 7 embodiment.
Figure 9:
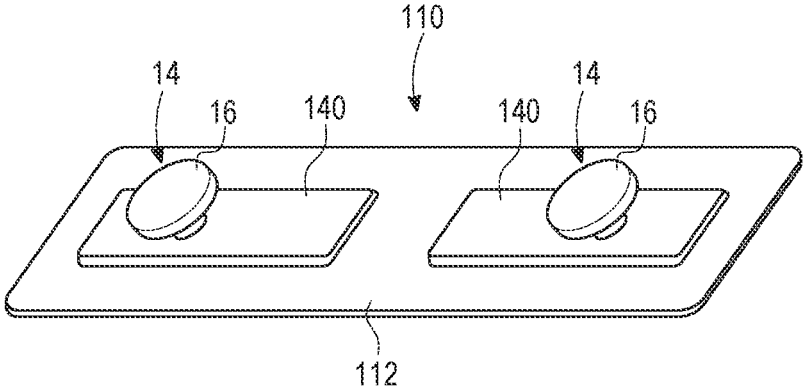
FIG. 9 is a perspective view of the FIG. 7 embodiment.
Figure 10:
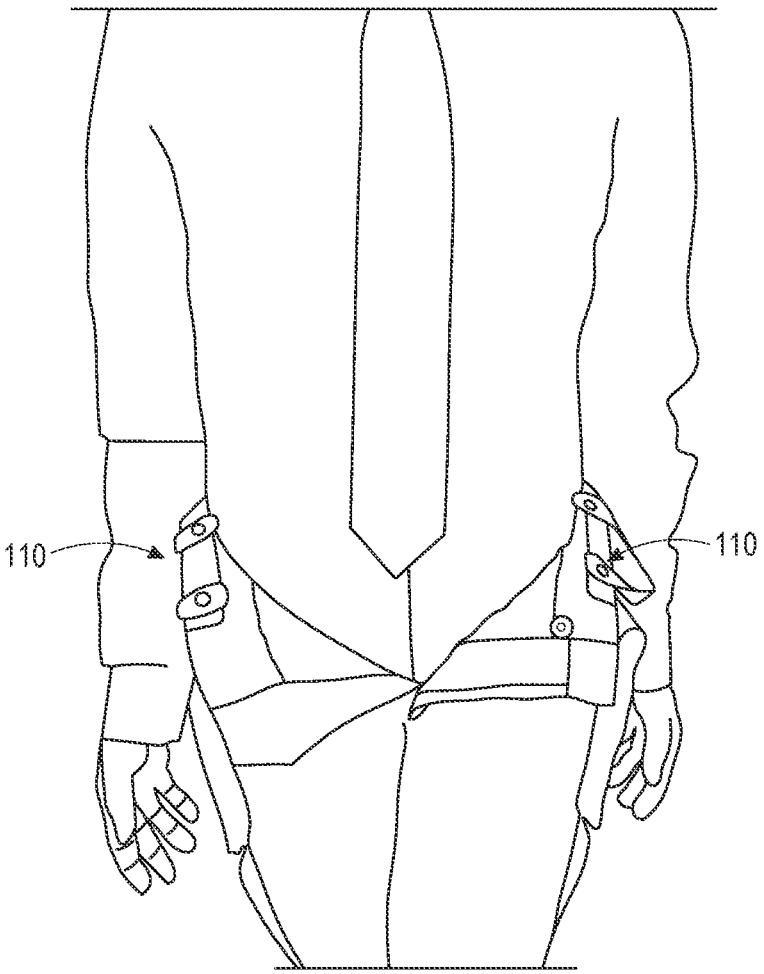
FIG. 10 is a photograph of the FIG. 7 embodiment in association with an open pair of pants.
Figure 11:
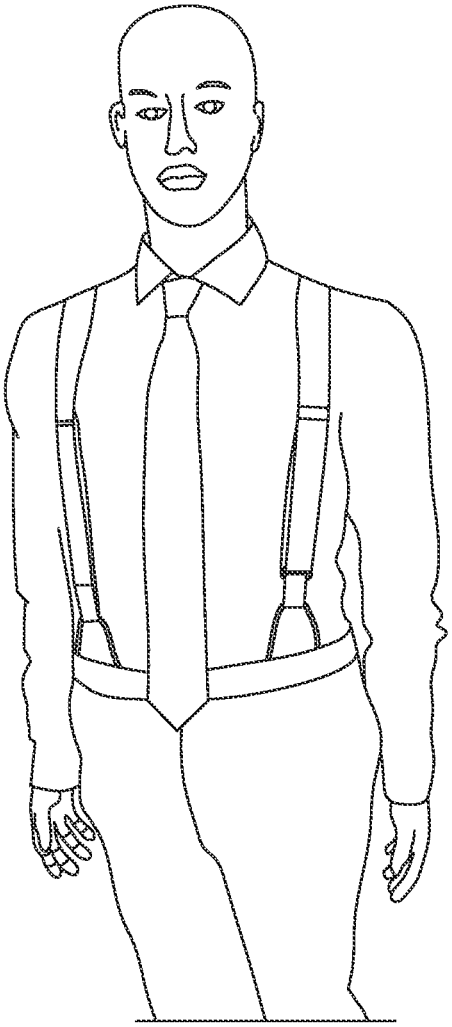
FIG. 11 is a photograph of the FIG. 7 embodiment in association with a closed pair of pants.

A further embodiment of the inventive concept is seen in FIGS. 7 and 8, showing front elevation and top plan views. Unlike the element 10 of the first embodiment, the further embodiment 110 can be operatively installed on a garment for receiving a pair of belt loops of a pair of suspenders without the cover 30 used in association with the element 10. In general, the element 110 has a pair of spaced-apart knobs 14, each with a head 16 and a post 17 that spaces the head away from the body 112. Body 112 has a length and width that would be substantially identical to that of body 12, but the thickness of body 112 may be thinner, at least around the periphery of the body. It has been noted that by forming the body using a technique such as injection molding and using a polymer such as polypropylene, the peripheral edge of the body 112 may be sufficiently thin that the body 112 may be directly sewn using a conventional sewing machine. In such a case, the needle penetrates the body 112 and secures the body to the garment.

In some instances of this further embodiment 110, there may be a raised shoulder portion 140 from which the knobs 14 extend. As depicted, it seems to be preferred to have one shoulder portion 140 with each knob 14. The shoulder portions 140 do not join together into a unitary shoulder portion, thereby maintaining a flexibility of the body 112 about axis W as seen in FIG. 1. These raised shoulder portions 140 also seem to be useful in flowing the thermoplastic into the mold from a rear side of the body 112. These raised shoulder portions 140 can also serve as a guide for a sewing machine foot, guiding the needle of the sewing machine around the periphery of the body 12 when attaching the device to the garment.

What is claimed is:

1. A device for attaching a garment having a waist band to suspenders, comprising:

an elongate rectangular body with a front surface and a back surface, the front surface comprising peripheral edges;

at least one raised shoulder portion on the front surface of the elongate rectangular body, each raised shoulder portion being adjacent to an open peripheral edge thereof; and at least one knob fixedly attached to and projecting from a raised shoulder portion, each knob comprising a head held in spaced-apart relationship with a raised shoulder portion by a post.

2. The device of claim 1, wherein the elongate rectangular body has ratio of length to width that is the range of about 4:1 to about 10:1.

3. The device of claim 2, wherein the elongate rectangular body has a ratio of width to thickness in the range of about 8:1 to about 20:1.

4. The device of claim 1 wherein the body and each knob are formed from a thermoplastic.

5. The device of claim 1, wherein each knob is integrally formed with a raised shoulder portion.

6. The device of claim 5, wherein each raised shoulder portion is integrally formed with the elongate rectangular body.

7. The device of claim 1, wherein the means for attaching the elongate rectangular body to the garment comprises at least one piece of a cover material encompassing the elongate rectangular body, the at least one piece of cover material comprising a material suitable for being sewn to the garment.

8. The device of claim 1, wherein the body comprises high density polyethylene.

9. The device of claim 1, wherein the at least one knob comprises two or more knobs each spaced apart from one another by at least one inch.

10. The device of claim 1, wherein each peripheral edge of the elongate rectangular body is open.

11. The device of claim 10, wherein each raised shoulder portion is centrally disposed on the front surface of the elongate rectangular body.

12. The device of claim 11, wherein the at least one raised shoulder portion comprises a raised shoulder portion that is rectangular and elongated along the same dimension as the elongate rectangular body.

13. The device of claim 1, wherein the body comprises polypropylene.

* * * * *